US009531066B2

(12) United States Patent
An et al.

(10) Patent No.: US 9,531,066 B2
(45) Date of Patent: Dec. 27, 2016

(54) ANTENNA PATTERN FRAME AND ELECTRONIC DEVICE INCLUDING THE SAME

(71) Applicant: SAMSUNG ELECTRO-MECHANICS CO., LTD., Suwon-Si, Gyeonggi-Do (KR)

(72) Inventors: Chan Gwang An, Suwon-Si (KR); Hyun Sam Mun, Suwon-Si (KR); Dae Kyu Lee, Suwon-Si (KR); Ha Ryong Hong, Suwon-Si (KR); Sung Eun Cho, Suwon-Si (KR); Dae Seong Jeon, Suwon-Si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 0 days.

(21) Appl. No.: 14/717,940

(22) Filed: May 20, 2015

(65) Prior Publication Data

US 2016/0079657 A1 Mar. 17, 2016

(30) Foreign Application Priority Data

Sep. 11, 2014 (KR) ..... 10-2014-0120460

(51) Int. Cl.

| | |
|---|---|
| ***H01Q 1/24*** | (2006.01) |
| ***H01Q 1/12*** | (2006.01) |
| ***H01Q 1/40*** | (2006.01) |
| ***H01Q 9/42*** | (2006.01) |

(52) U.S. Cl.

CPC ..... *H01Q 1/40* (2013.01); *H01Q 1/1207* (2013.01); *H01Q 1/243* (2013.01); *H01Q 9/42* (2013.01)

(58) Field of Classification Search

None

See application file for complete search history.

(56) References Cited

U.S. PATENT DOCUMENTS

2010/0271270 A1 10/2010 Sung et al.
2010/0271272 A1* 10/2010 Sung et al. ..... H01Q 1/243 343/702

FOREIGN PATENT DOCUMENTS

KR 10-0935954 B1 1/2010
KR 10-2010-0117012 A 11/2010
KR 10-0995470 B1 11/2010

OTHER PUBLICATIONS

Office Action issued on Jun. 18, 2015, in the corresponding Korean Patent Application No. 10-2014-0120460, 5 pages in English, 5 pages in Korean.

* cited by examiner

*Primary Examiner* — Robert Karacsony
(74) *Attorney, Agent, or Firm* — NSIP Law

(57) ABSTRACT

There is provided an antenna pattern frame including: a radiator including an antenna pattern part transmitting and receiving signals and a connection terminal part electrically connecting the antenna pattern part and a circuit board to each other; and a radiator frame provided by performing injection molding on the radiator while allowing the antenna pattern part to be exposed to one surface thereof and allowing the connection terminal part to be exposed to the other surface thereof, wherein the antenna pattern part is provided with a support part protruding outwardly from the antenna pattern part and bent in a direction toward the radiator frame to be disposed inwardly of the radiator frame.

9 Claims, 7 Drawing Sheets

ANTENNA PATTERN FRAME AND ELECTRONIC DEVICE INCLUDING THE SAME

CROSS-REFERENCE TO RELATED APPLICATION

This application claims the priority and benefit of Korean Patent Application No. 10-2014-0120460 filed on Sep. 11, 2014, with the Korean Intellectual Property Office, the disclosure of which is incorporated herein by reference.

BACKGROUND

The present disclosure relates to an antenna pattern frame and an electronic device including the same.

Mobile communications terminals supporting wireless communications such as mobile phones, personal digital assistants (PDAs), navigation devices, notebooks, and the like, have been developed to include functions such as code division multiple access (CDMA), wireless local area networks (LAN), digital multimedia broadcasting (DMB), and the like. One of the most important components of mobile communications terminals enabling such functions is the antennas thereof.

Research into integrating the antenna with the mobile communications terminal in order to miniaturize the mobile communications terminal and enhance durability of the antenna has been actively conducted.

Here, as a method of integrating the antenna with the mobile communications terminal, there is provided an injection molding method of fixing a radiator including an antenna pattern formed thereon in a mold and injecting resin into the mold.

However, in order to fix the radiator in place in the injection molding method, a guide pin may be provided in the mold, and here, a penetrating hole may be formed in an injection molding product due to the guide pin, and moisture may be introduced into the penetrating hole, such that the water-proof feature of the product may deteriorate.

SUMMARY

An aspect of the present disclosure may provide an antenna pattern frame having improved water-proof features, and an electronic device including the same.

An aspect of the present disclosure may also provide an antenna pattern frame having improved binding strength between a radiator and a radiator frame, and an electronic device including the same.

According to an aspect of the present disclosure, an antenna pattern frame may include: a radiator including an antenna pattern part transmitting and receiving signals and a connection terminal part electrically connecting the antenna pattern part and a circuit board to each other; and a radiator frame formed by performing injection molding on the radiator while allowing the antenna pattern part to be exposed to one surface thereof and allowing the connection terminal part to be exposed to the other surface thereof, wherein the antenna pattern part may be provided with a support part protruding outwardly from the antenna pattern part and bent in a direction in which the radiator frame is provided to be disposed inwardly of the radiator frame.

Here, a guide hole may be provided in the support part, and a guide pin may be inserted into the guide hole of a mold at the time of injection molding.

Therefore, an area of a bottom surface of the antenna pattern part exposed externally after injection molding may be significantly decreased by allowing the antenna pattern part and the guide pin to be spaced apart from each other.

In addition, a portion of the support part may be disposed inside the radiator frame, such that binding strength between the radiator and the radiator frame may be increased.

According to another aspect of the present disclosure, an electronic device may include: the antenna pattern frame as described above; a circuit board electrically connected to the connection terminal part to receive signals from the radiator and transmit signals to the radiator; and a housing in which the antenna pattern frame and the circuit board are mounted.

BRIEF DESCRIPTION OF DRAWINGS

The above and other aspects, features and advantages of the present disclosure will be more clearly understood from the following detailed description taken in conjunction with the accompanying drawings, in which.

DETAILED DESCRIPTION

Figure 1:
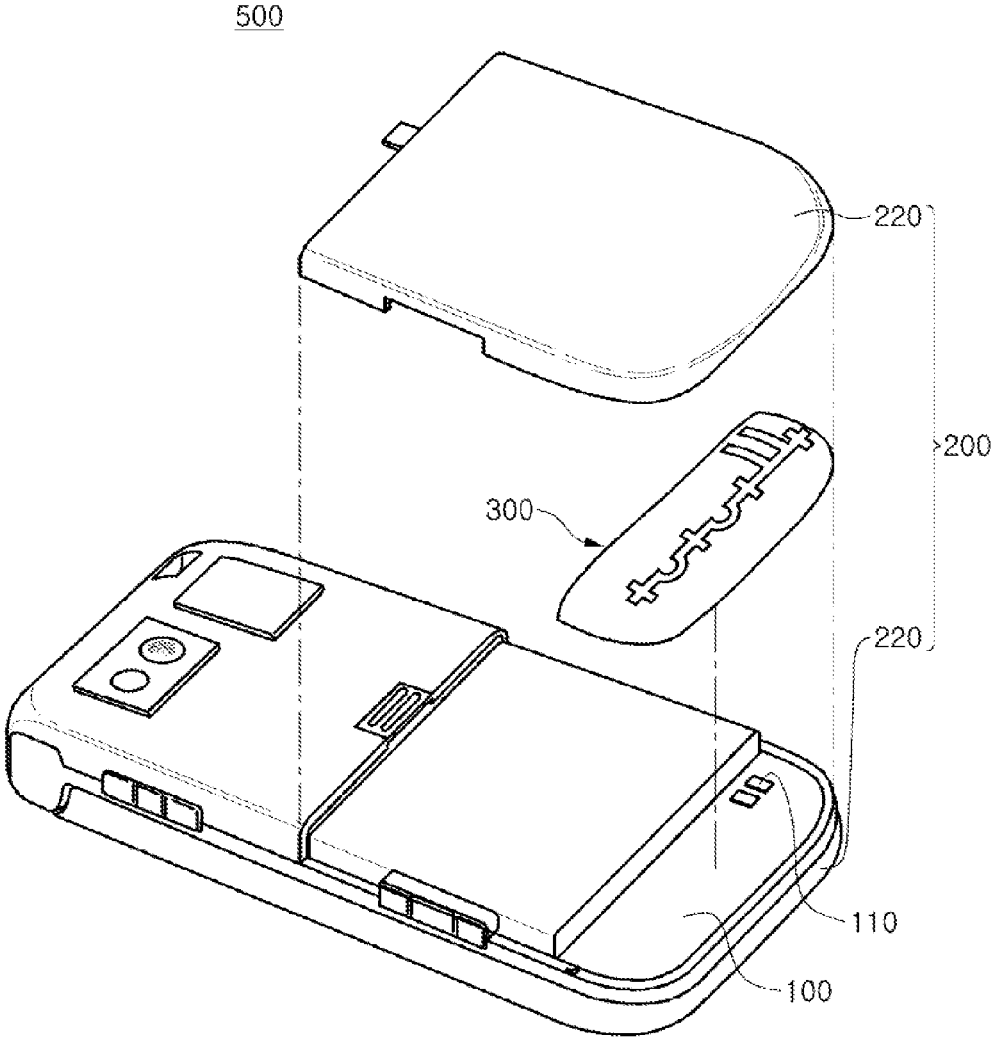
FIG. 1 is an exploded perspective view of an electronic device according to an exemplary embodiment in the present disclosure.

Hereinafter, embodiments of the present disclosure will be described in detail with reference to the accompanying drawings.

The disclosure may, however, be embodied in many different forms and should not be construed as being limited to the embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

Figure 2:
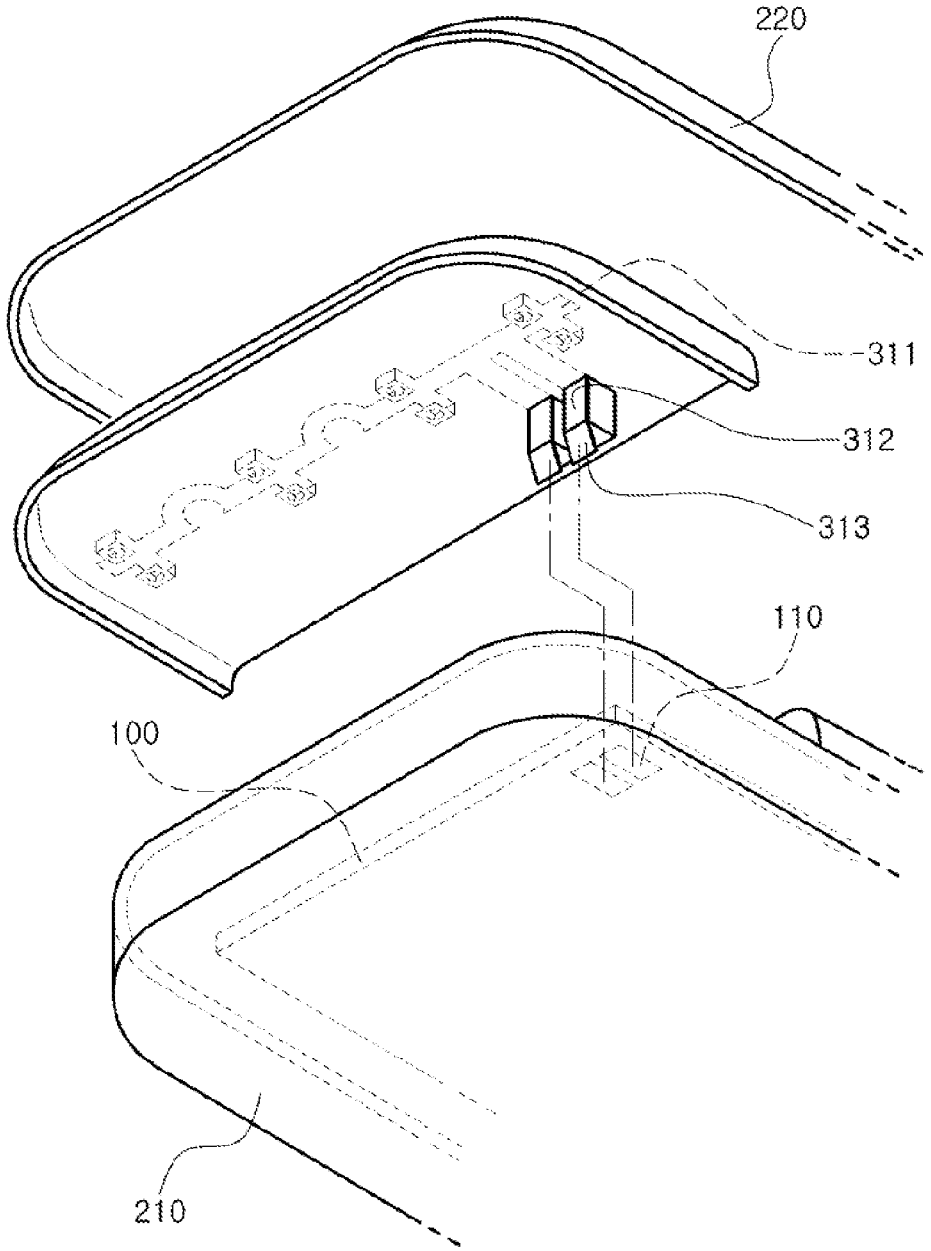
FIG. 2 is a schematic exploded perspective view schematically illustrating an electronic device manufactured using an antenna pattern frame according to an exemplary embodiment in the present disclosure.

FIG. 1 is an exploded perspective view of an electronic device 500 according to an exemplary embodiment in the present disclosure, and FIG. 2 is a schematic exploded perspective view schematically illustrating the electronic device 500 manufactured using an antenna pattern frame 300 according to an exemplary embodiment in the present disclosure.

Referring to FIGS. 1 and 2, the electronic device 500 according to an exemplary embodiment in the present disclosure may include a circuit board 100, a housing 200, and the antenna pattern frame 300.

As the circuit board 100, various kinds of boards well known in the art (for example, a ceramic board, a printed circuit board (PCB), or the like), may be used.

In addition, at least one electronic component may be mounted on one surface of the circuit board 100, and a mounting electrode for mounting an electronic component or a wiring pattern (not illustrated) electrically connecting the mounting electrodes to each other may be provided thereon.

Here, the circuit board 100 may be a multilayer circuit board composed of a plurality of layers, and a conductive via (not illustrated) for electrically connecting each of the layers may be provided between each of the layers.

Further, a terminal 110, for connection with a radiator 310 to be described below, may be provided in the circuit board 100.

The radiator 310 may be electrically connected to the terminal 110 of the circuit board 100 to transfer signals received from the outside to the circuit board 100 or transfer signals received from the circuit board 100 to the outside, thereby serving as an antenna.

The housing 200, which is a member forming the exterior appearance of the electronic device 500, may include a front case 210 and a rear cover 220.

Various electronic elements for driving the electronic device 500 and the above-mentioned circuit board 100 may be coupled to the front case 210.

In addition, the antenna pattern frame 300 may be coupled to a portion of the front case 210 and the rear cover 220 may be provided on the antenna pattern frame 300.

That is, the front case 210 and the rear cover 220 may be coupled to each other to form an internal space, and various electronic elements required for driving the electronic device 500, the circuit board 100, and the antenna pattern frame 300 may be mounted in the internal space.

The rear cover 220 may be provided on the antenna pattern frame 300 to prevent the antenna pattern frame 300 from being exposed externally.

The front case 210 and the rear cover 220 may be detachably coupled to each other. For example, the rear cover 220 may be coupled to the front case 210 by a hook.

Meanwhile, the front case 210 and the rear cover 220 may be formed of plastic. For example, the front case 210 and the rear cover 220 may be formed by injection molding of a resin material. However, the material of the front case 210 and the rear cover 220 is not limited thereto, and may be variously changed as long as the front case 210 and the rear cover 220 may accommodate the electronic elements, the circuit board 100, and the antenna pattern frame 330 therein.

Figure 3:
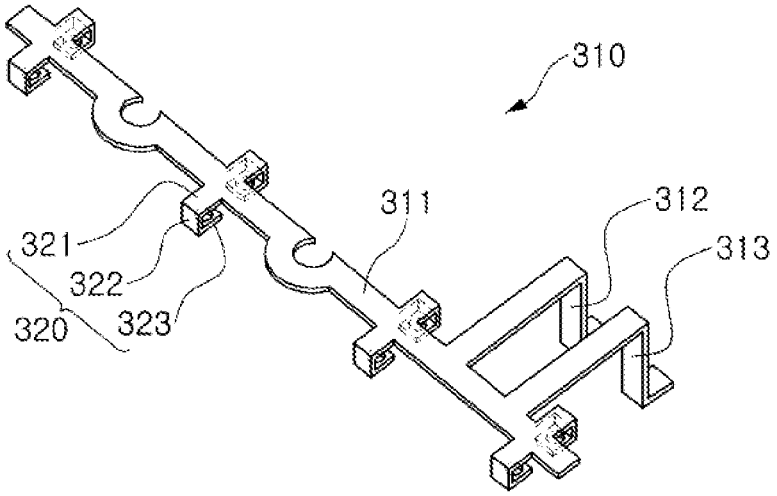
FIG. 3 is a schematic perspective view illustrating a radiator according to an exemplary embodiment in the present disclosure.
Figure 4:
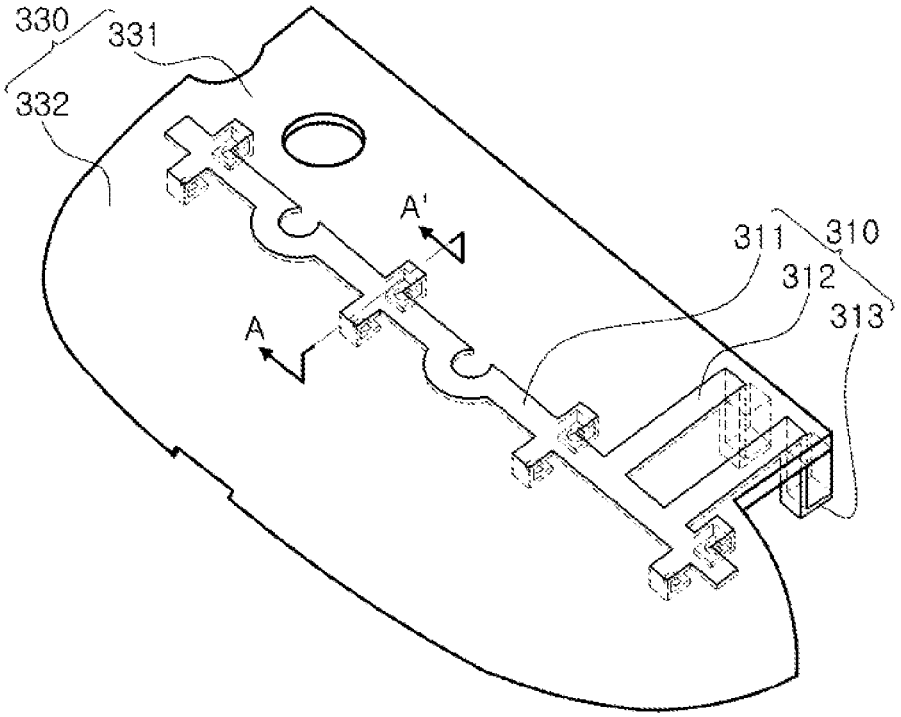
FIG. 4 is a schematic perspective view illustrating the antenna pattern frame according to an exemplary embodiment in the present disclosure.
Figure 5:
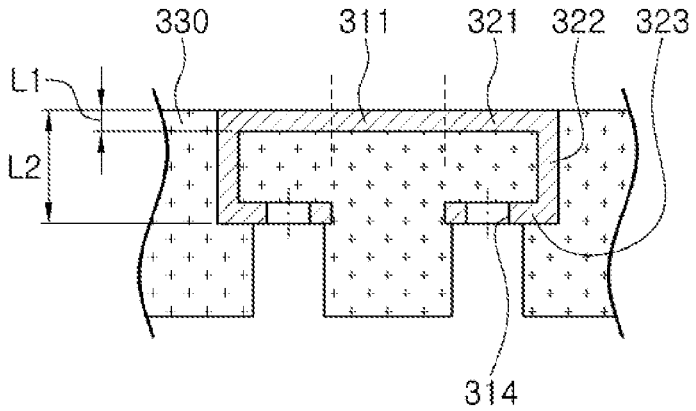
FIG. 5 is a cross-sectional view taken along line A-A' of FIG. 4.

FIG. 3 is a schematic perspective view illustrating the radiator 310 according to an exemplary embodiment in the present disclosure, FIG. 4 is a schematic perspective view illustrating the antenna pattern frame 300 according to an exemplary embodiment in the present disclosure, and FIG. 5 is a cross-sectional view taken along line A-A' of FIG. 4.

Referring to FIGS. 3 through 5, the antenna pattern frame 300 according to an exemplary embodiment in the present disclosure may include the radiator 310 and a radiator frame 330.

The radiator 310 may include an antenna pattern part 311, a connection part 312, and a connection terminal part 313.

The radiator 310 may be manufactured using a conductive material such as aluminum, copper, or the like, and receive external signals to transfer the signals to a signal processing device (not illustrated) provided in the electronic device 500 or transfer signals of the electronic device 500 to an external receiver.

In addition, the radiator 310 may have a meandering shape in order to receive external signals in various bands.

Meanwhile, the radiator 310 may include the antenna pattern part 311 transmitting and receiving signals and the connection terminal part 313 electrically connecting the antenna pattern part 311 and the circuit board 100 to each other in order to transmit the received signal to the electronic device 500 or the signals of the electronic device to the outside.

Here, the radiator 310 may have a three-dimensional structure formed by bending the antenna pattern part 311 and the connection terminal part 313, respectively, and the antenna pattern part 311 and the connection terminal part 313 may be connected to each other by the connection part 312.

In this case, the connection part 312 may connect the antenna pattern part 311 and the connection terminal part 313 to each other so that the antenna pattern part 311 is formed on one surface of a radiator frame 330 to be described below and the connection terminal part 313 is formed on the other surface of the radiator frame 330.

Here, one surface of the radiator frame 330 refers to a surface of the radiator frame 330 facing the rear cover 220 and the other surface of the radiator frame 330 refers to a surface of the radiator frame 330 facing the circuit board 100 in FIG. 2.

Meanwhile, the antenna pattern part 311 may be provided with a support part 320 protruded outwardly of the antenna pattern part 311 and bent in a direction in which the radiator frame 330 is provided so that a portion of a bent portion thereof is disposed inwardly of the radiator frame 330.

In detail, the support part 320 may include an extension portion 321 protruded outwardly of the antenna pattern part 311 to thereby be exposed to one surface of the radiator frame 330, a first bend portion 322 bent from an end of the extension portion 321 in a direction toward the other surface of the radiator frame 330, and a second bend portion 323 bent again from an end of the first bend portion 322.

Figure 12:
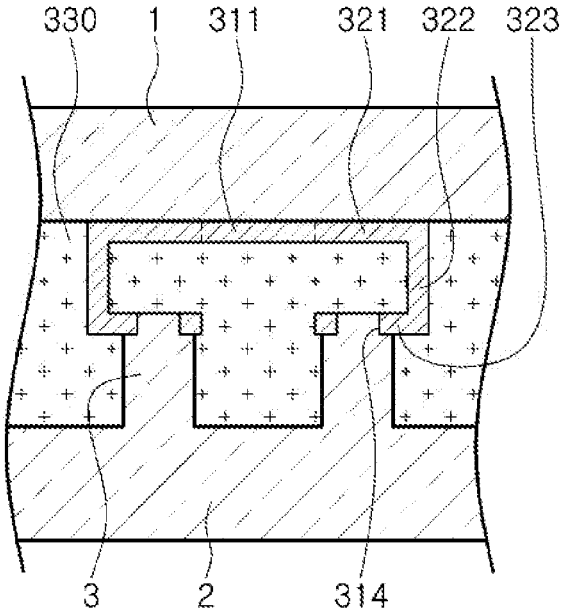
FIG. 12 is a schematic cross-sectional view illustrating the radiator according to an exemplary embodiment in the present disclosure, which is disposed in a mold.

Hereinafter, the configuration and function of the support part 320 in the antenna pattern frame 300 according to an exemplary embodiment in the present disclosure will be described in detail with reference to FIG. 12.

A guide hole 314 into which a guide pin 3 of a lower mold 2 is inserted at the time of injection molding may be provided in the second bend portion 323 of the support part 320.

The guide hole 314 may be provided in order to prevent the radiator 310 from being floated or pushed at the time of injection molding. That is, a resin material is injected through an injection hole of molds 1 and 2 under high temperature and high pressure conditions at the time of injection molding. At this time, if the radiator 310 is not fixed to the mold, the radiator 310 may deviate from a preset position, such that product defects may occur. Therefore, the guide hole 314 of the radiator 310 maybe an essential component in injection molding.

In this case, in the radiator 310 according to an exemplary embodiment, the guide hole 314 may be provided in the second bend portion 323 spaced apart from the antenna pattern part 311. Therefore, when injection molding is completed, the second bend portion 323 exposed to the other surface of the radiator frame 330 may be spaced apart from the antenna pattern part 311, and the radiator frame 330 may be provided in a space between the second bend portion 323 and the antenna pattern part 311.

Generally, in the case of forming a guide hole in an antenna pattern part to perform injection molding, a hole penetrating through the guide hole of the antenna pattern part may be formed in the antenna pattern frame.

Therefore, external moisture may permeate into the antenna pattern frame.

However, in the antenna pattern frame 300 according to an exemplary embodiment in the present disclosure, the radiator frame 330 may be formed between the antenna pattern part 311 and the second bend portion 323 by providing the guide hole 314 in the second bend portion 323 to perform injection molding, such that it is not necessary to form a hole penetrating through the guide hole 314 in the antenna pattern frame 300, and a water-proof function may be improved.

In addition, the support part 320 may improve binding strength between the radiator 310 and the radiator frame 330.

That is, since the support part 320 is bent and provided in the direction in which the radiator frame 330 is provided, the support part 320 of a hook-like shape may fix the radiator 310 to the radiator frame 330 and increase a contact area, thereby improving binding strength.

Therefore, a phenomenon in which the radiator 310 is separated from the antenna pattern frame 300 may be prevented.

A portion of a bottom surface of the support part 320 fixed by the guide pin 3 may be exposed to the other surface of the radiator frame 330 (see FIG. 5).

In addition, the support part 320 may be provided in pairs on both sides of the antenna pattern part 311 in a width direction thereof, and a plurality of support parts 320 may be provided in a length direction of the antenna pattern part 311 so as to be spaced apart from each other.

However, the positions of the support parts 320 are not limited thereto, and the support parts 320 may be provided in various positions on the radiator 310 in accordance with circumstances in consideration of a structure or design.

Figure 9:
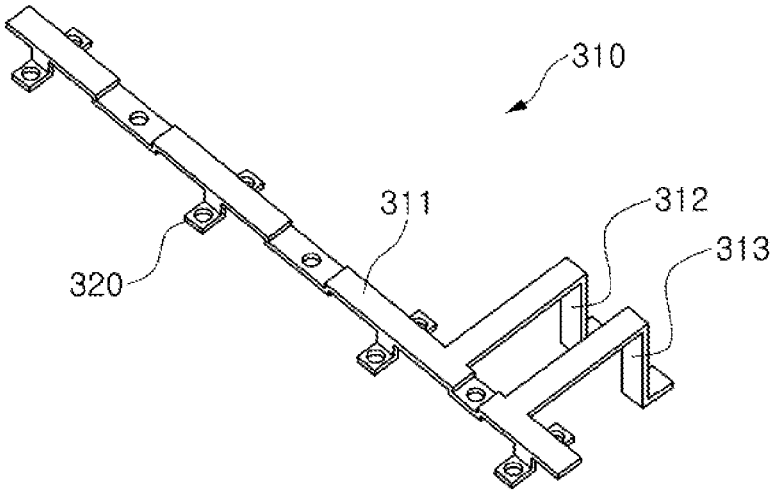
FIG. 9 is a schematic perspective view illustrating a radiator according to another exemplary embodiment in the present disclosure.
Figure 10:
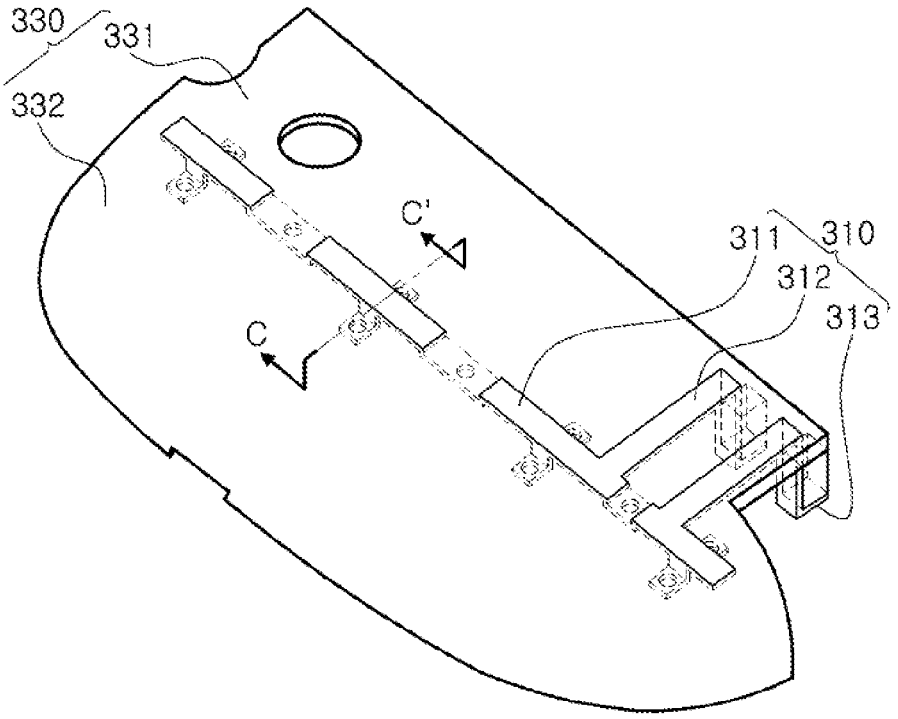
FIG. 10 is a schematic perspective view illustrating an antenna pattern frame according to another exemplary embodiment in the present disclosure.
Figure 11:
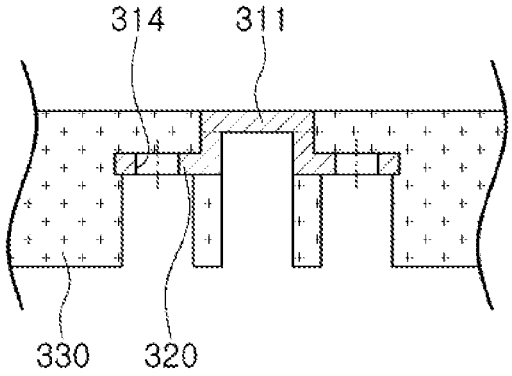
FIG. 11 is a cross-sectional view taken along line C-C' of FIG. 10.

Meanwhile, a modified example of the support part 320 is illustrated in FIGS. 9 through 11. Referring to FIGS. 9 through 11, the support part 320 may be bent from the antenna pattern part 311 in a direction toward the other surface of the radiator frame 330 and then bent again in a direction toward the outside of the antenna pattern part 311.

The function of the support part 320 according to this exemplary embodiment is substantially the same as that of the support part 320 according to the previous exemplary embodiment.

The radiator frame 330 may be manufactured by performing injection molding on the radiator 310, and after the radiator frame 330 is manufactured, the connection terminal part 313 of the radiator 310 may be provided to have elasticity. That is, when the injection molding of the radiator 310 is completed, the connection terminal part 313 may be rotated and bent to be spaced apart from the radiator frame 330.

In this case, since the radiator 310 is formed of an elastic material, the connection terminal part 313 may have natural elasticity. Therefore, the connection terminal part 313 may elastically come in contact with the terminal 110 of the circuit board 100.

The radiator frame 330 is an injection molding structure, and the antenna pattern part 311 may be formed on one surface of the radiator frame 330 while the connection terminal part 313 may be formed on the other surface of the radiator frame 330.

Meanwhile, a protective coating film (not illustrated) may be formed on one surface of the radiator frame 330 and the antenna pattern part 311.

That is, in the case in which the antenna pattern frame 300 is mounted on the front case 210, since the antenna pattern part 311 is exposed externally, the antenna pattern part 311 may be additionally covered with a coating film, or the like, for protection of the antenna pattern part 311.

The antenna pattern frame 300 is not exposed externally in a state in which the rear cover 220 is covered, but in the case in which the rear cover 220 is opened for exchanging a battery, or the like, the antenna pattern frame 300 is exposed externally, and thus the coating film may be used for an exterior design and protection of the antenna pattern part.

In this case, the coating film may be instantly formed by spraying a liquid using a coating or painting method or formed by attaching a separate member such as a film, a coating, or the like.

Figure 6:
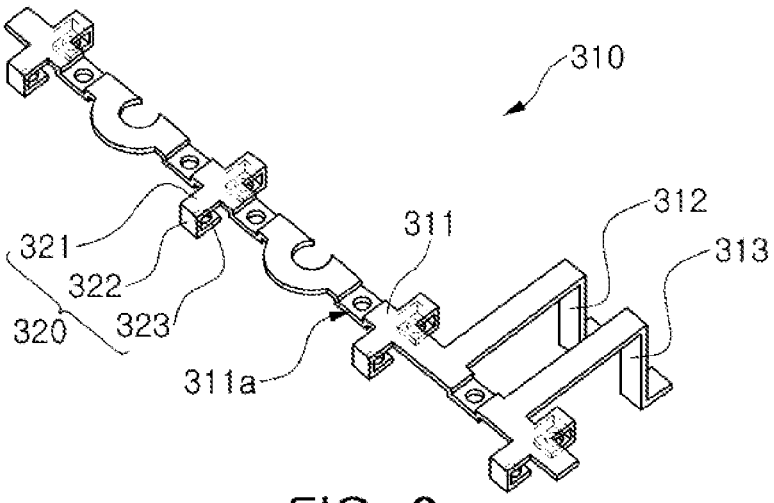
FIG. 6 is a schematic perspective view illustrating a radiator according to another exemplary embodiment in the present disclosure.
Figure 7:
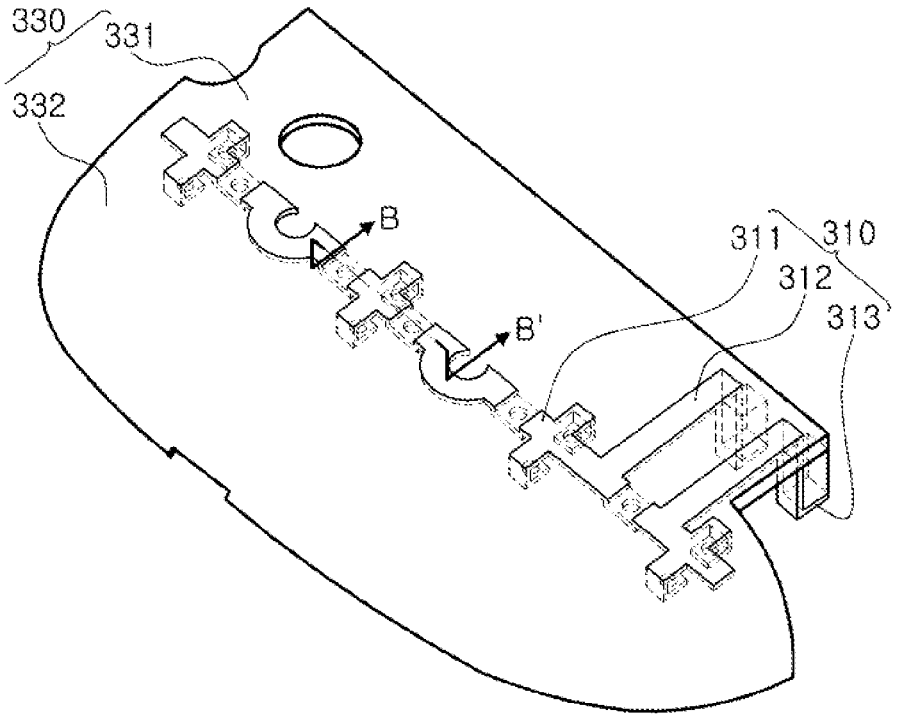
FIG. 7 is a schematic perspective view illustrating an antenna pattern frame according to another exemplary embodiment in the present disclosure.
Figure 8:
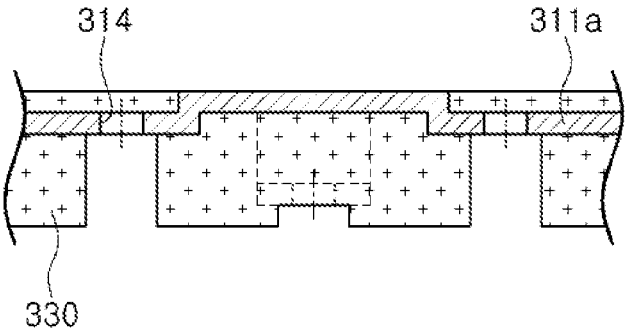
FIG. 8 is a cross-sectional view taken along line B-B' of FIG. 7.

FIG. 6 is a schematic perspective view illustrating a radiator according to another exemplary embodiment in the present disclosure, FIG. 7 is a schematic perspective view illustrating an antenna pattern frame according to another exemplary embodiment in the present disclosure, and FIG. 8 is a cross-sectional view taken along line B-B' of FIG. 7.

Referring to FIGS. 6 through 8, the antenna pattern frame 300 according to another exemplary embodiment in the present disclosure may include the radiator 310 and the radiator frame 330.

In addition, the configuration of the antenna pattern frame 300 according to this exemplary embodiment is the same as that of the antenna pattern frame 300 according to the exemplary embodiment illustrated in FIGS. 1 through 5, excepting for the structure of the radiator 310. Therefore, a detailed description of the same configuration will be omitted.

In the antenna pattern frame 300 according to this exemplary embodiment, the radiator 310 may include an antenna pattern part 311, a connection part 312, and a connection terminal part 313.

Here, a portion of the antenna pattern part 311 is provided with a step part 311a depressed in a direction in which the radiator frame 330 is provided.

A guide hole 314 may be provided in the step part 311*a*, and a portion of a bottom surface of the step part 311*a* provided with the guide hole 314 may be exposed to the other surface of the radiator frame 330.

The step part 311*a* may be disposed inside of the radiator frame 330, such that only a portion of the antenna pattern part 311 in which the step part is not formed may be exposed to one surface of the radiator frame 330.

The step part 311*a* may reinforce binding strength between the radiator 310 and the radiator frame 330, without forming a hole in the antenna pattern frame 300, similarly to the support part 320.

As set forth above, in the antenna pattern frame according to exemplary embodiments in the present disclosure, the water-proof function may be improved.

While exemplary embodiments have been shown and described above, it will be apparent to those skilled in the art that modifications and variations could be made without departing from the scope of the present invention as defined by the appended claims.

What is claimed is:

1. An antenna pattern frame comprising:

a radiator including an antenna pattern part transmitting and receiving signals and a connection terminal part electrically connecting the antenna pattern part and a circuit board to each other; and a radiator frame provided by performing injection molding on the radiator while allowing the antenna pattern part to be exposed to one surface thereof and allowing the connection terminal part to be exposed to the other surface thereof, wherein the antenna pattern part is provided with a support part protruding outwardly from the antenna pattern part and bent in a direction in which the radiator frame is provided to be disposed inwardly of the radiator frame, and wherein the support part includes:

an extension portion protruding outwardly from the antenna pattern part to thereby be exposed to the one surface of the radiator frame;

a first bend portion bent from an end of the extension portion in a direction toward the other surface of the radiator frame; and a second bend portion bent from the first bend portion and provided with a guide hole.

2. The antenna pattern frame of claim 1, wherein a portion of a bottom surface of the second bend portion is exposed to the other surface of the radiator frame.

3. The antenna pattern frame of claim 1, wherein the support part is provided in pairs on both sides of the antenna pattern part in a width direction thereof.

4. The antenna pattern frame of claim 1, wherein the support part comprises a plurality of support parts provided in a length direction of the antenna pattern part to be spaced apart from each other.

5. The antenna pattern frame of claim 1, wherein a portion of the antenna pattern part is provided with a step part depressed in a direction in which the radiator frame is provided.

6. The antenna pattern frame of claim 5, wherein the step part is disposed inside the radiator frame, such that a portion of a bottom surface of the step part is exposed to the other surface of the radiator frame.

7. The antenna pattern frame of claim 5, wherein the step part is provided with a guide hole.

8. The antenna pattern frame of claim 5, wherein a portion of the antenna pattern part in which the step part is not formed is exposed to one surface of the radiator frame.

9. An electronic device comprising:

the antenna pattern frame of claim 1;

a circuit board electrically connected to the connection terminal part to receive signals from the radiator and transmit signals to the radiator; and a housing in which the antenna pattern frame and the circuit board are mounted.

* * * * *